United States Patent [19]

Schmidt

[11] 4,383,919

[45] May 17, 1983

[54] SCREEN BOTTOM SYSTEM

[75] Inventor: Gerhard Schmidt, Ettlingen, Fed. Rep. of Germany

[73] Assignee: Hein, Lehmann AG, Dusseldorf, Fed. Rep. of Germany

[21] Appl. No.: 241,804

[22] Filed: Mar. 9, 1981

[30] Foreign Application Priority Data

Mar. 8, 1980 [DE] Fed. Rep. of Germany ..... 3008931

[51] Int. Cl.[3] ..... B07B 1/49

[52] U.S. Cl. ..... 209/399; 209/405; 209/931

[58] Field of Search ..... 209/44.1, 680, 682, 209/931, 399, 405, 414

[56] References Cited

U.S. PATENT DOCUMENTS

| | | | |
|---|---|---|---|
| 3,980,555 | 9/1976 | Freissle | 209/399 X |
| 4,120,784 | 10/1978 | Hassall | 209/399 |
| 4,219,412 | 8/1980 | Hassall | 209/399 |

*Primary Examiner*—Allen N. Knowles

*Attorney, Agent, or Firm*—Allison C. Collard; Thomas M. Galgano

[57] ABSTRACT

In this screening bottom, the screening elements which are mounted on a support structure are provided with an exchangeable and automatically clamped rubber plate acting as a wear-and-tear resistant layer. Beneath the rubber plate, a reinforcing structure is provided consisting of plastic ribs and/or a reinforced structure which is imbedded in a plastic material, as well as clamping elements. The reinforced structure and the clamping elements constitute a unitary grid which is undetachably coupled with the rubber plate. Thereby, it is possible to transfer the advantages from the unit construction assembly technique to screening bottoms with associated screening elements which basically are composed of rubber with a high abrasion resistance characteristic. No complicated and expensive vulcanization molds and devices are required for making the screening elements. The molding tools which are already available for making plastic screening elements can be partially used.

6 Claims, 2 Drawing Figures

SCREEN BOTTOM SYSTEM

The invention relates to a screen or screening bottom system. More particularly, it relates to such a system made in accordance with the unit construction principle assembly technique having a support structure which is provided with support elements and with exchangeable reinforced screening elements mounted thereon made of an elastic plastic material which, on their lower sides, are provided with clamping elements cooperating with the support elements which are made of a castable plastic material, in particular, polyurethane.

A screening bottom of this type is generally used for dewatering and/or classifying material, for example, stones, sand, gravel and the like. Such a screening bottom is known from German Auslegeschrift 28 49 838 which consists of a support frame with support elements having a C-shaped cross-sectional profile and screening elements which are made in one piece or unitarily from a rubberized elastic plastic material. The plastic material used is mostly polyurethane (PUR) with a high abrasive resistance characteristic and a shore hardness above 80 A, and, typically, about 90 A. The use of the screening bottoms with screening elements made with such plastic material has shown to be very effective, especially in the wet-screening method for minerals.

However, certain limitations had to always be accepted, especially when dealing with very hard stones, for example, granite, flint or quartz, which have to be screened in a dry coarse state. Obviously, the elasticity of the abrasion-resistant but comparatively hard plastic materials is not sufficient.

It is therefore an object of the invention to provide a screening bottom which is simple to make and assemble and which holds an adequate supply of material.

It is also an object of this invention to provide such a screening bottom which has a large screen capacity and screening elements which have a very high stability against very abrasive screen material.

These objects of the invention are obtained by the provision of a screening bottom of the aforementioned type which includes screening elements provided with a wear-and-tear resistant layer in the form of a perforated rubber plate, a reinforced structure composed of plastic material ribs and/or a reinforced structure imbedded in a plastic material, and clamping elements consisting of the same plastic material which are completely and non-detachably attached thereto. In this case, the reinforcement is not in the form of an underlying support plate but is in the form of a coarse mesh grid, or the like, made of rods, profiles or wire ropes, which is preferably completely imbedded in the plastic material. The rubber plate is coupled with the imbedded reinforcement in the area of the plate portions or ribs which are free of screen apertures and between which at least a field of screen openings are disposed. In strip-like screening elements, the reinforcement preferably extends at a right angle, that is, transversely to the screening elements.

Thereby, it is possible to apply the advantages of the unit construction principle to screening bottoms with screening elements, which basically consist of rubber with a high abrasion-resistant characteristic. No complicated and expensive vulcanization molds and devices are required for making the screening elements. The molding tools which are already available for making screen elements can be partially used. A particularly useable material for the rubber plate is a highly wear-and-tear resistant rubber having a hardness of about 70 Shore A.

For technical screening and manufacturing reasons, it is advantageous that the reinforcement which is imbedded in plastic and the plastic clamping elements form a unitary grid or grate on which the rubber plate is mounted directly, completely and non-detachably.

A particularly advantageous feature is that the self-acting clamping elements are disposed on at least two oppositely-arranged side edges of the rubber plate and are provided with an inner rib disposed parallel to the associated side edge of the rubber plate, as well as an outer extension separated from the rib by a groove formed therebetween. The manufacturing of the screening elements can be carried out even more economically and simply by completely preassembling the rubber plate before coupling the same to the clamping elements and the provided reinforcement structure. For this purpose, the rubber plate may be cut off from a larger unit, for example, a plate or a roll and can be perforated thereafter.

An adhesive is preferably provided between the rubber plate and the clamping elements to increase the stability of the connection between these corresponding parts.

Other objects and features of the present invention will become apparent from the following description when taken in connection with the accompanying drawing which discloses one embodiment of the invention. It is to be understood that the drawing is designed for the purpose of illustration only and is not intended as a definition of the limits of the invention.

In the drawing, wherein similar reference characters denote similar elements throughout the several views.

Figure 1:
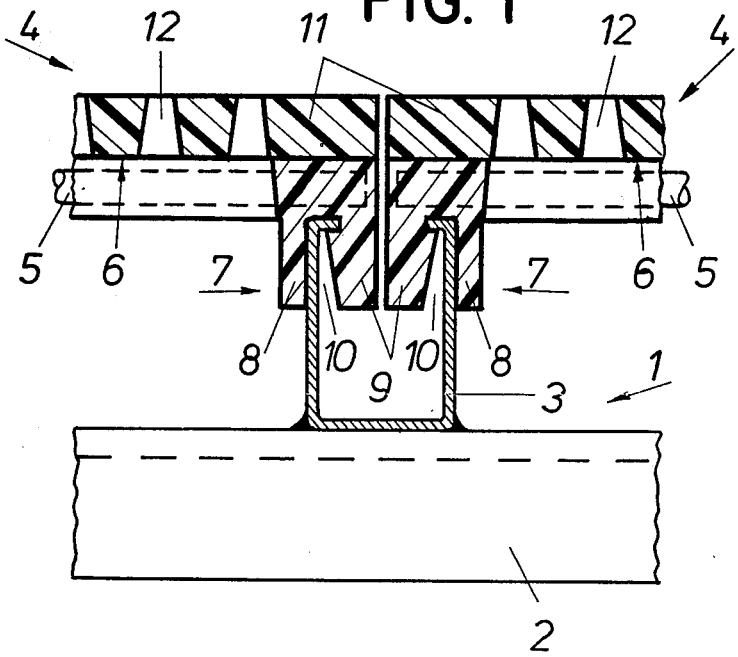
FIG. 1 is a sectional view of an inventive screening bottom.

Referring now in detail to the drawing, FIG. 1 illustrates a sectional view of an inventive screening bottom. The screening bottom is provided with a support structure 1 composed of a frame 2 having support elements 3. Support elements 3 which have a C-shaped cross-sectional profile may be rigidly or detachably coupled with frame 2. The preferably stripe-, band- or strip-shaped screening elements 4 of the screening bottom are provided with reinforcement members 5.

Clamping elements 7 are connected on the lower side 6 of screening elements 4, flush with the side edge of screening elements 4. With the assistance of clamping elements 7, screening elements 4 are automatically clamped onto support elements 3. The automatic or self-acting clamping members 7 are disposed on the oppositely-arranged side edges of the corresponding screening elements 4. They are provided with an inner rib or arm 8 disposed parallel to the associated side edge and an outer extension 9. A cut-out groove 10 is provided between rib 8 and its outer extension 9 in which the associated shank of support element 3 is retained.

Screening elements 4 are provided with a rubber plate 11 acting as a wear-and-tear resistant layer. On the lower side 6 of rubber plate 11, there are provided reinforcement members 5 which are imbedded in a plastic material, in particular, polyurethane, as well as clamping elements 7 which are disposed along the side edges. Clamping elements 7 and reinforcement members 5 form a unitary coarse grid or a unitary wide-slotted grate on which the rubber plate is mounted as a wear-and-tear resistant layer. Therefore, the rubber plate can swing freely at certain zones which is advantageous to render the device free from being plugged up.

Preferably, the rubber plate is completely pre-assembled. For this purpose, it can be cut off from a larger plate or from a roll and it can be provided with the screening apertures by means of stamping, for example. Thereafter, the finished rubber plate is completely and undetachably connected with the unitary grid or the wide-slotted grate which forms the lower part. In order to increase the stability of the connection, an adhesive is applied between the rubber plate and the grate or the grid, respectively.

Figure 2:
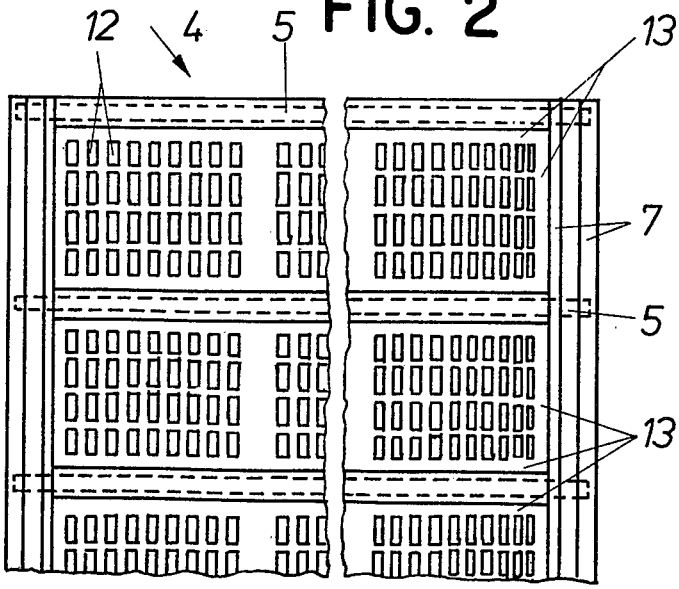
FIG. 2 is a fragmentarily-illustrated bottom view of a screening element of the same screening bottom.

FIG. 2 illustrates a bottom view of screening element 4 of the screening bottom shown in FIG. 1. In particular, the grid or grate structure with the reinforcement members 5 which is imbedded in plastic can be seen, which structure is completely and undetachably coupled with the lower side of the rubber plate. Therefore, the rubber plate is not supported over its total face but only in stripes or bands in the areas of web 13 which are free of screen openings 12. The free areas of the rubber plate between these unperforated web strips 13 can swing freely.

Thus, while only one embodiment of the present invention has been shown and described, it will be obvious that many changes and modifications may be made thereunto, without departing from the spirit and scope of the invention.

What is claimed is:

1. In a screening bottom system made in accordance with the unit construction principle assembly technique of the type including a support structure composed of a plurality of support elements, a plurality of exchangeable reinforced screening elements mounted on said support elements made of an elastic plastic material, and a plurality of clamping elements cooperating with the support elements and made of a castable plastic material, the improvement comprising:

said screening elements being provided with a wear-and-tear resistant layer in the form of a perforated rubber plate and being reinforced with an at least partially plastic reinforced structure and wherein said clamping elements are made of the same plastic material as said reinforced structure and are completely and non-detachably secured thereto.

2. The system according to claim 1, wherein said reinforced structure comprises plastic ribs imbedded in a plastic material and said clamping elements together with said reinforced structure basically form a unitary grid on which said rubber plate is immediately, completely and non-detachably mounted.

3. The system according to claim 1, wherein said clamping elements are disposed on at least two oppositely-arranged side edges of said rubber plate and wherein said clamping elements are provided with an inner rib disposed parallel to the associated side edge of said rubber plate and an outer extension associated with said rib, and wherein a groove is formed between said rib and the inner side of said extension.

4. The system according to claim 1, wherein said rubber plate is completely preassembled before being coupled with said clamping elements.

5. The system according to claim 1, 2, 3 or 4 wherein said rubber plate and said clamping elements are coupled with each other by means of an adhesive.

6. The system according to claim 1, wherein said castable plastic material comprises polyurethane.

* * * * *